US008758322B2

(12) United States Patent
McCoy et al.

(10) Patent No.: US 8,758,322 B2
(45) Date of Patent: Jun. 24, 2014

(54) DISPENSING INSERT FOR A MEDICINE CONTAINMENT AND DISPENSING SYSTEM AND ASSOCIATED METHOD

(71) Applicant: Target Brands, Inc., Minneapolis, MN (US)

(72) Inventors: Ryan P. McCoy, Falcon Heights, MN (US); Stacy Abel, Maple Grove, MN (US); Matthew P. Franks, Austin, TX (US); Gordon Beecroft, Leola, PA (US); John Vassallo, Lititz, PA (US); Michael Makhlouf, Lititz, PA (US)

(73) Assignee: Target Brands, Inc., Minneapolis, MN (US)

( * ) Notice: Subject to any disclaimer, the term of this patent is extended or adjusted under 35 U.S.C. 154(b) by 0 days.

(21) Appl. No.: 13/659,630

(22) Filed: Oct. 24, 2012

(65) Prior Publication Data

US 2013/0102989 A1 Apr. 25, 2013

Related U.S. Application Data

(60) Provisional application No. 61/551,365, filed on Oct. 25, 2011.

(51) Int. Cl.

| | |
|---|---|
| ***A61J 1/20*** | (2006.01) |
| ***A61J 1/14*** | (2006.01) |
| ***B65D 1/02*** | (2006.01) |
| ***B65D 25/48*** | (2006.01) |
| ***B65D 39/00*** | (2006.01) |
| ***B65D 45/30*** | (2006.01) |
| ***B65D 47/06*** | (2006.01) |
| ***B65D 50/04*** | (2006.01) |
| ***B65D 51/00*** | (2006.01) |

(52) U.S. Cl.

CPC *A61J 1/2096* (2013.01); *A61J 1/20* (2013.01); *A61J 1/1412* (2013.01); *A61J 2001/1425* (2013.01); *A61J 2001/2003* (2013.01); *A61J 2001/2048* (2013.01); *B65D 1/02* (2013.01); *B65D 25/48* (2013.01); *B65D 39/00* (2013.01); *B65D 39/0005* (2013.01); *B65D 45/30* (2013.01); *B65D 47/06* (2013.01); *B65D 50/04* (2013.01); *B65D 51/002* (2013.01)

USPC ..... 604/403; 604/415; 604/416

(58) Field of Classification Search

CPC ..... B65D 1/02; B65D 1/08; B65D 25/48; B65D 39/00; B65D 39/0005; B65D 39/0023; B65D 39/0029; B65D 39/0035; B65D 39/02; B65D 39/025; B65D 39/08; B65D 45/02; B65D 45/30; B65D 45/305; B65D 47/06; B65D 50/04; A61J 1/20

USPC ..... 604/403, 407, 415, 416; 215/40, 41, 42, 215/43, 44, 45, 50, 200, 201, 234, 273, 316, 215/317, 320, 321, 354; 141/319, 346

See application file for complete search history.

(56) References Cited

U.S. PATENT DOCUMENTS

| | | | |
|---|---|---|---|
| 1,115,597 | A | 11/1914 | Sherman |
| 1,697,716 | A | 1/1929 | Chace |

(Continued)

OTHER PUBLICATIONS

Office Action from Canadian Patent Application No. 2,793,173, mailed Jul. 5, 2013 (3 pages).

(Continued)

*Primary Examiner* — Adam Marcetich

(74) *Attorney, Agent, or Firm* — Griffiths & Seaton PLLC; JoAnn M. Seaton

(57) ABSTRACT

A dispensing insert is configured to friction fit within a neck of a bottle and to selectively receive an oral syringe. The dispensing insert includes a hollow cylinder, a top plate capping one end of the hollow cylinder, a raised deck extending substantially parallel to and spaced from the top plate, and an annular side wall extending from the top plate upwardly toward the raised deck. The raised deck has a smaller outer diameter than the top plate and defines an opening therethrough configured to provide access to contents of the pharmacy bottle through the dispensing insert. The annular sidewall substantially encompasses an outer perimeter of the raised deck.

21 Claims, 11 Drawing Sheets

(56) References Cited

U.S. PATENT DOCUMENTS

| | | | | | |
|---|---|---|---|---|---|
| 2,135,386 | A | | 11/1938 | Crabbe | |
| 2,142,278 | A | | 1/1939 | Mendelson | |
| 2,190,054 | A | | 2/1940 | Cutter et al. | |
| 2,388,634 | A | | 11/1945 | Woody | |
| 2,438,024 | A | | 3/1948 | Stransky | |
| 2,459,304 | A | | 1/1949 | Blank | |
| 2,783,908 | A | * | 3/1957 | Winfield | 215/247 |
| 3,321,098 | A | | 5/1967 | Ogle | |
| 3,762,612 | A | * | 10/1973 | Miller | 222/479 |
| 3,900,028 | A | * | 8/1975 | McPhee | 604/415 |
| 4,230,112 | A | | 10/1980 | Smith | |
| 4,303,071 | A | | 12/1981 | Smith | |
| 4,317,448 | A | | 3/1982 | Smith | |
| 4,995,521 | A | * | 2/1991 | von Schuckmann | 215/249 |
| 5,036,992 | A | | 8/1991 | Mouchawar et al. | |
| 5,419,446 | A | * | 5/1995 | Cox et al. | 215/21 |
| 5,429,256 | A | * | 7/1995 | Kestenbaum | 215/247 |
| 5,454,805 | A | | 10/1995 | Brony | |
| RE35,167 | E | | 3/1996 | Mouchawar et al. | |
| 5,620,434 | A | | 4/1997 | Brony | |
| 5,924,584 | A | | 7/1999 | Hellstrom et al. | |
| 6,571,971 | B1 | * | 6/2003 | Weiler | 215/247 |
| 7,284,580 | B2 | | 10/2007 | Dallison et al. | |
| 2005/0061765 | A1 | * | 3/2005 | Skillin et al. | 215/235 |
| 2008/0009822 | A1 | * | 1/2008 | Enerson | 604/411 |
| 2008/0015539 | A1 | | 1/2008 | Pieroni et al. | |
| 2008/0053565 | A1 | * | 3/2008 | Py et al. | 141/329 |
| 2008/0147037 | A1 | | 6/2008 | Foster | |
| 2010/0230447 | A1 | * | 9/2010 | Eriksen | 222/481.5 |
| 2010/0327010 | A1 | | 12/2010 | Manera et al. | |
| 2012/0103462 | A1 | * | 5/2012 | Levy | 141/2 |

OTHER PUBLICATIONS

"Press-In Bottle Adapters," printed from www.medidose.com/press-inbottleadapter.aspx available as early as 2010 (3 pages).

Images of Target Bottle Insert publicly used more than one year prior to Oct. 24, 2011 (1 page).

Office Action from Canadian Patent Application No. 2,793,173, mailed Feb. 25, 2013 (3 pages).

* cited by examiner

DISPENSING INSERT FOR A MEDICINE CONTAINMENT AND DISPENSING SYSTEM AND ASSOCIATED METHOD

CROSS-REFERENCE TO RELATED APPLICATION

This application is a non-provisional application of and claims priority to U.S. Provisional Patent Application No. 61/551,365, filed Oct. 25, 2011, which is incorporated herein by reference.

BACKGROUND OF THE INVENTION

Virtually everyone consumes prescription pharmaceuticals at one time or another. A large number of prescription pharmaceuticals are for liquid medications, especially in the area of pediatrics. Pouring and measuring individual doses of liquid medications has long been a less than precise task prone to spilling or waste of the liquid medication or other messy interactions. As such, oral or needleless syringes have been developed to provide cleaner and more accurate means for measuring individual doses of liquid medication.

To provide for selective reception of needleless syringes in a substantially airtight manner, adapters are typically placed in medication containment vessels, such as bottles, to limit the size of an opening providing access to the liquid medication while still enabling a tip or nozzle of the needleless syringe to be connected in fluid communication with an interior of the bottle and the liquid medicine contained therein. Improvements in adapters are desired that both contribute to increased accuracy in measuring individual dosages of medicine, lessened amounts of wasted or inadvertently dispensed liquid medicine, and address other shortcoming of conventional bottle adapters.

SUMMARY

One embodiment of the invention relates to a dispensing insert configured to friction fit within a neck of a bottle and to selectively receive an oral syringe. The dispensing insert includes a hollow cylinder, a top plate capping one end of the hollow cylinder, a raised deck extending substantially parallel to and spaced from the top plate, and an annular side wall extending from the top plate upwardly toward the raised deck. The raised deck has a smaller outer diameter than the top plate and defines an opening therethrough configured to provide access to contents of the pharmacy bottle through the dispensing insert. The annular sidewall substantially encompasses an outer perimeter of the raised deck. Other dispensing inserts, associated medicine dispensing containment systems, and associated methods are also described herein.

BRIEF DESCRIPTION OF THE DRAWINGS

Embodiments of the invention will be described with respect to the figures, in which like reference numerals denote like elements, and in which.

DETAILED DESCRIPTION

In the following detailed description, reference is made to the accompanying drawings, which form a part hereof, and in which are shown by way of illustration specific embodiments in which the invention may be practiced. The following detailed description, therefore, is not to be taken in a limiting sense, and the scope of the present invention is defined by the appended claims.

Figure 1:
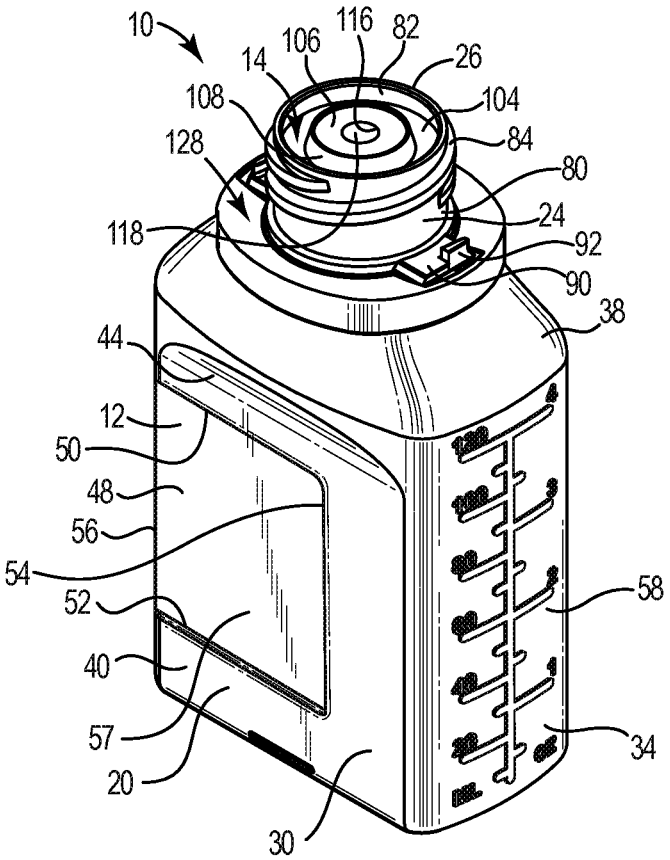
FIG. 1 is a front, top perspective view illustration of a medicine containment and dispensing system including a bottle and a liquid dispensing insert, according to one embodiment of the invention.
Figure 2:
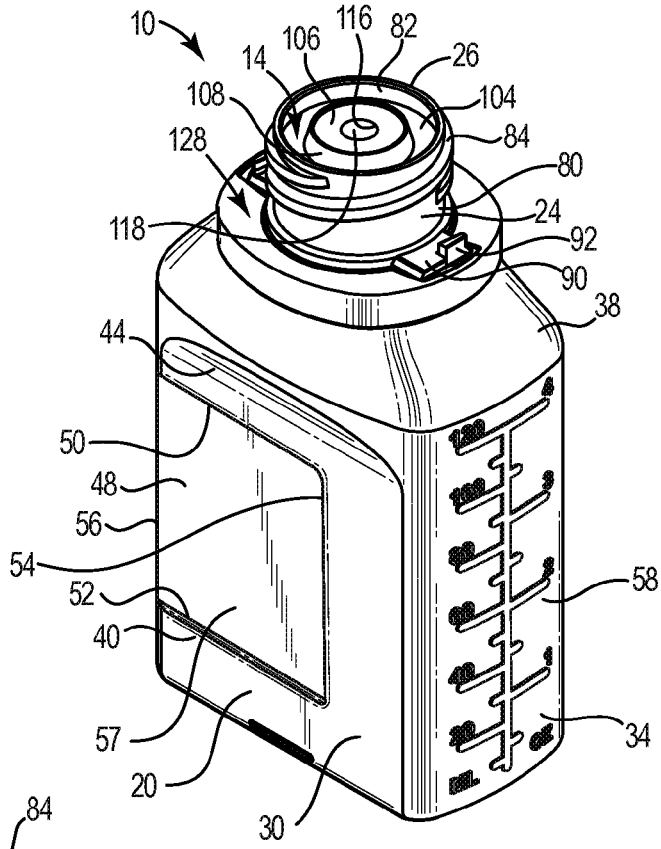
FIG. 2 is a front, top perspective view illustration of a bottle of the medicine containment and dispensing system of FIG. 1, according to one embodiment of the invention.
Figure 3:
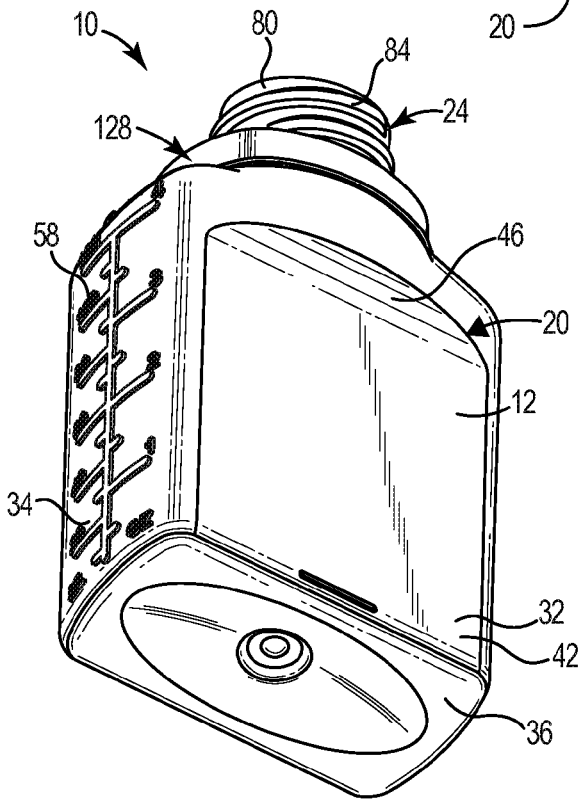
FIG. 3 is a rear, bottom perspective view illustration of the bottle of FIG. 2, according to one embodiment of the invention.
Figure 4:
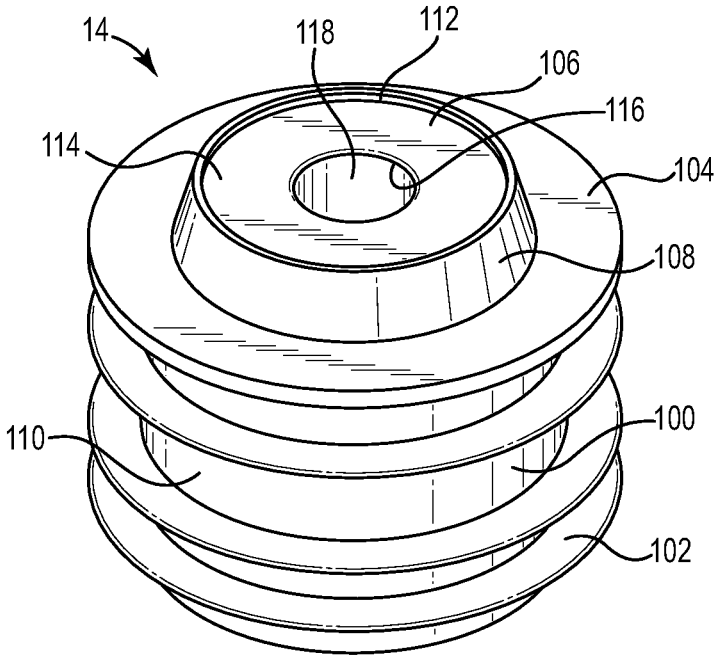
FIG. 4 is a front, top perspective view illustration of a liquid dispensing insert of the medicine containment and dispensing system of FIG. 1, according to one embodiment of the invention.
Figure 5:
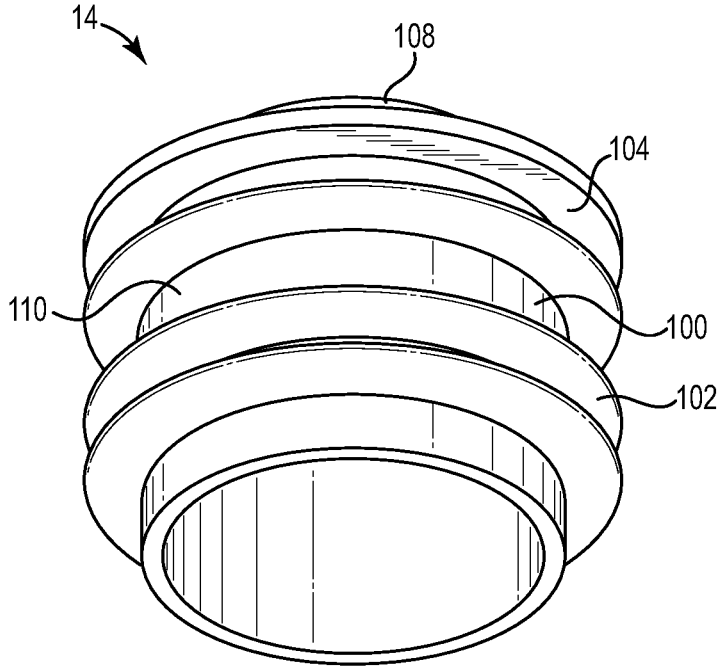
FIG. 5 is a rear, bottom, and perspective view illustration of the liquid dispensing insert of FIG. 4, according to one embodiment of the invention.
Figure 6:
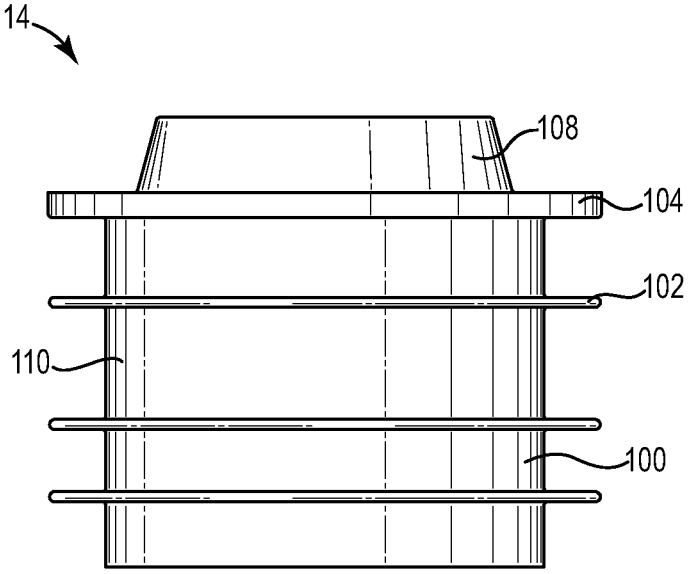
FIG. 6 is a front view illustration of the liquid dispensing insert of FIG. 4, according to one embodiment of the invention; the rear view of the liquid dispensing insert is identical to the front view.
Figure 7:
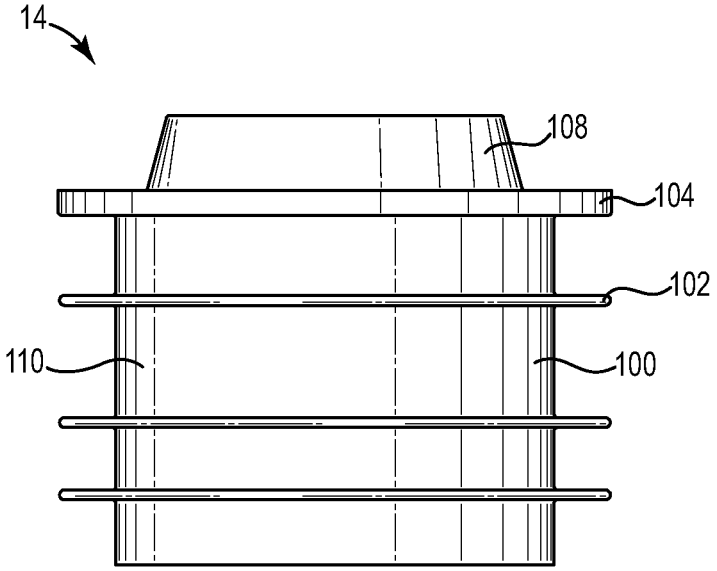
FIG. 7 is a right side view illustration of the liquid dispensing insert of FIG. 4, according to one embodiment of the invention; the left side view of the liquid dispensing insert is identical to the right side view.
Figure 8:
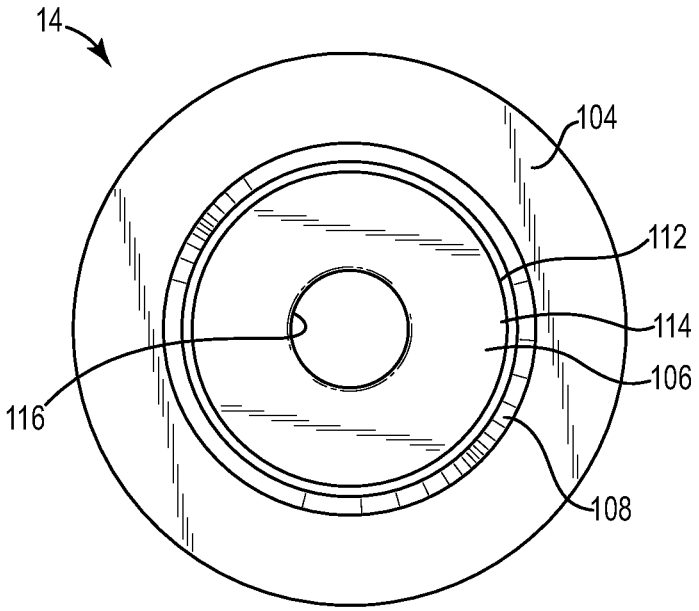
FIG. 8 is a top view illustration of the liquid dispensing insert of FIG. 4, according to one embodiment of the invention.
Figure 9:
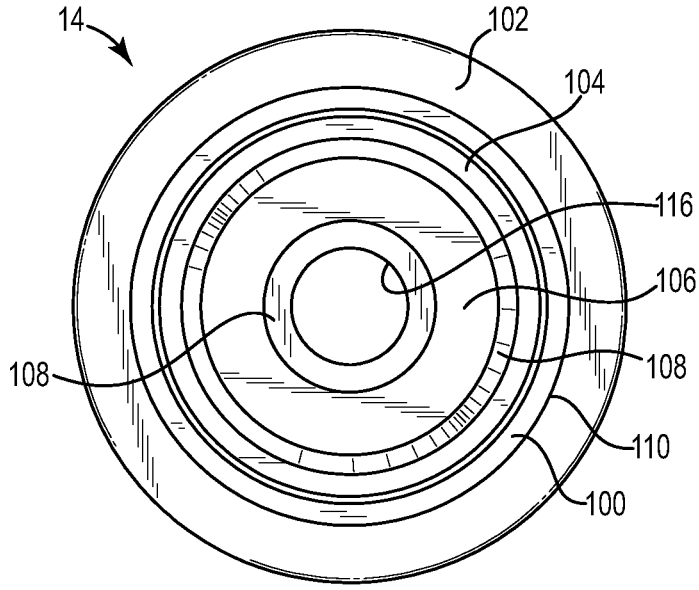
FIG. 9 is bottom view illustration of the liquid dispensing insert of FIG. 4, according to one embodiment of the invention.
Figure 10:
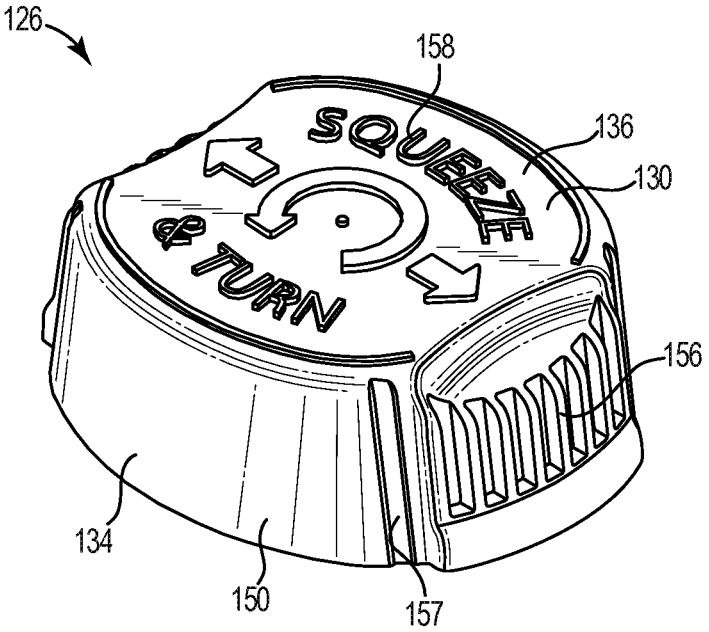
FIG. 10 is a front, top perspective view illustration of a closure for use as part of the medicine containment and dispensing system of FIG. 1, according to one embodiment of the invention.
Figure 14:
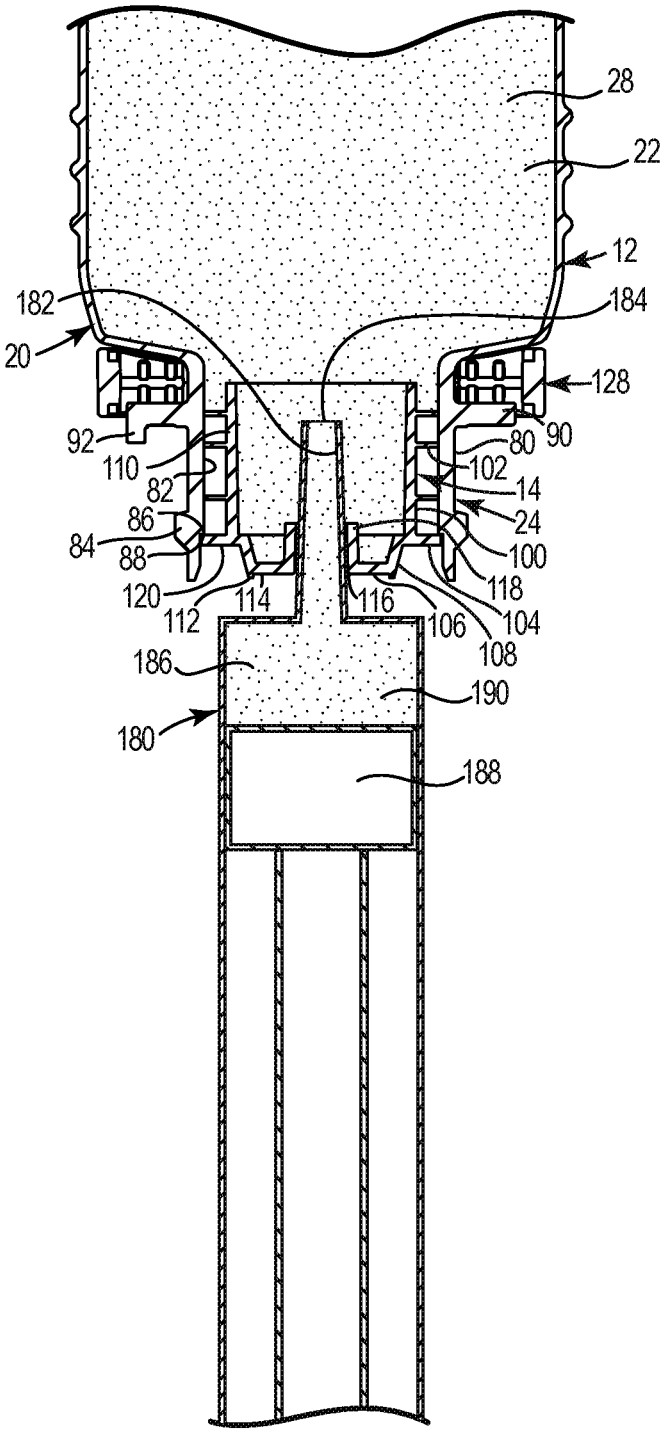
FIG. 14 is an inverted version of the cross-section view of FIG. 13 in combination with a corresponding cross-sectional view of a needleless syringe for use as part of the medicine containment and dispensing system of FIG. 12, according to one embodiment of the present invention.

Referring to FIGS. 1-3, embodiments of the invention are directed to a pharmacy containment and dispensing system 10 including a bottle 12 and bottle adapter or dispensing insert 14 to facilitate removal of medicine 28 (FIG. 14) in individual doses from bottle 12 using an oral or other needleless syringe 180 (FIG. 14). Bottle 12 includes a body 20 defining a storage chamber 22, a neck 24 extending upwardly from body 20, and a mouth or opening 26 providing access to the storage chamber 22 defined within bottle 12 via neck 24. In one embodiment, neck 24 receives dispensing insert 14 entirely within the confines of neck 24 rather than sitting on top of neck 24. Dispensing insert 14 and its position within neck 24 provide for secure containment of medicine 28 therein, closure of opening 26, and relatively neat and easy dispensing of liquid medicine 28 from bottle 12. In particular, the dispensing insert 14 additionally limits introduction of air into the associated needleless syringe 180 such that accurate measurements of liquid medication 28 are ensured.

In one embodiment, body 20 includes a front panel 30, a rear panel 32, side panels 34, and a spine or bottom panel 36. Front panel 30 is positioned opposite rear panel 32, and one of side panels 34 extends between front panel 30 and rear panel 32 on either side of bottle 12 to define storage chamber 22 therebetween. Accordingly, body 20 is one example of means for containing liquid medicine 28. Bottom panel 36 extends between front panel 30, rear panel 32, and side panels 34 to enclose an end of bottle 12. In one embodiment, bottom panel 36 is substantially planar such that bottle 12 can be placed with bottom panel 36 on a support surface (not shown) such that bottle 12 is supported by and extends upwardly from bottom panel 36.

Neck 24 extends away from a portion of bottle 12 opposite bottle panel 36 to form an end of bottle 12 opposite bottom panel 36. In one embodiment, body 20 of bottle 12 defines shoulders 38 extending and tapering from front panel 30, rear panel 32, and side panels 34 to neck 24 opposite bottom panel 36. Neck 24 defines opening 26 opposite body 20 adjacent a topmost edge of neck 24, and opening 26 provides access to storage chamber 22 permitting liquid medicine 28 to be placed in and be removed from storage chamber 22 via opening 26. In one embodiment, neck 24 is threaded, e.g., double threaded, and defines opening 26 opposite body 20 providing access through neck 24 to storage chamber 22 such that threads 84 of neck 24 are configured to threadably receive an appropriate closure, such as a closure 126 (FIGS. 10-13), to cover opening 26. As such, neck 24 with opening 26 with threads 84 is one example of means for providing a narrow passageway of other access to storage chamber 22 and for selectively receiving a closure, e.g., closure 126.

In one embodiment, front panel 30 and rear panel 32 of body 20 each define a substantially planar outer surface 40 and 42, respectively, that are each substantially rectangularly shaped, thereby defining a generally flat, broad surface especially suited for reading information on portions of a label (not shown) applied thereto (e.g., a label similar to that described in U.S. Pat. No. 7,311,205, filed Jan. 25, 2005, and issued Dec. 25, 2007, which is incorporated herein by reference). For example, substantially planar surfaces 40 and 42 enable display of label information in a manner in which all of the information printed on a portion of a label applied to each of substantially planar surfaces 40 and 42 can be read generally without turning or rotating bottle 12.

In one example, the relatively broad nature of substantially planar surfaces 40 and 42 of front panel 30 and rear panel 32 of container 20 enable bottle 12 to be set down on its side onto a support surface without bottle 12 rolling along the support surface. In particular, the breadth and relative flatness of front panel 30 or rear panel 32 prevent rolling of bottle 12 when either one of front panel 30 or rear panel 32 are placed directly on the support surface.

Continuing to refer to FIGS. 1 and 2, one of front panel 30 and rear panel 32 of body 20 (front panel 30 as illustrated in FIGS. 1 and 2) further comprises a recess 48 inwardly offset from the substantially planar surface 40 or 42, respectively. For example, recess 48 is a depression formed in substantially planar surface 40 of front panel 30 of body 20. In one embodiment, recess 48 comprises an upper edge 50, a lower edge 52, an inner edge 54, and an outer edge 56, and recess surface 58. Edges 50 and 52 define upper and lower boundaries of recess 48 while inner edge 54 and outer edge 56 define opposing lateral boundaries of recess 48. Accordingly, recess 48 extends only partially laterally across a width of rear panel 32 of body 20, terminating at inner edge 54. Outer edge 56 joins with an outer edge of a corresponding one of side panels 34 providing access to recess 48 via a side of body 20. In one embodiment, substantially planar surface 42 extends around three sides (e.g., a top, bottom, and side opposite the corresponding one of side panels 34) of recess 48.

In one embodiment, recess 48 is configured to selectively maintain an information card (not shown), such as a folded information card, and allow the information card to selectively slide into and out of recess 48 via the side opening at outer edge 56. To facilitate the maintenance of the information card in recess 48, in one example, a bottle label (not shown) is positioned to extend over and be adhered to substantially planar surface 42 around (e.g., on three sides of) recess in a manner remaining spaced from recess surface 57 as described in U.S. Pat. No. 7,311,205, which was incorporated by reference above. In such an embodiment, inner edge 54 of recess 48 is configured to prevent further sliding movement of an information card laterally inward into recess 48, and upper edge 50 and lower edge 52 of recess 48 define guides to help maintain lateral motion of the information card in and out of recess 48, and to maintain the information card within recess 48.

Substantially planar exterior surfaces 40 and 42 each curve outwardly (i.e., away from each other) at top portions 44 and 46, respectively, adjacent shoulders 38 in one embodiment. As such, an overall width of body 20 gradually increases beyond a largest width of each corresponding side panel 34. This increase in width is advantageous to allow for easy movement of medicine 28 toward neck 24 and opening 26, for example, for dispensing medicine 28 using needleless syringe 180 (FIG. 14).

In one embodiment, front panel 30 and rear panel 32 are generally symmetric with each other regarding a size and general shape (e.g., substantially rectangularly shaped) and side panels 34 are generally symmetric with each other regarding a size and general shape (e.g., substantially rectangular or alternatively substantially trapezoidally shaped). In another embodiment, front panel 30 and rear panel 32 are generally asymmetric with each other regarding a size or a general shape and side panels 34 are generally asymmetric with each other regarding a size or a general shape.

In one embodiment, one or both of side panels 34 includes graduation demarcations 58. For example, graduation demarcations 58 extend up at least one of side panels 34 and are formed to outwardly protrude from the respective at least one of side panels 34 as indicated in FIGS. 1-3. Graduation demarcations 58, as illustrated, include markings for two measurement forms (e.g., milliliters and ounces) extending vertically up the side of the respective side panel 34, but graduation demarcations 58 may take a variety of other configurations as will be apparent to those of skill in the art upon reading this application.

Turning back to a top portion of bottle 12, in one embodiment, shoulders 38, which extend inwardly from each of front panel 30, rear panel 32, and side panels 34 to a centrally located neck 24, taper inwardly to meet an exterior neck surface 80 of neck 24. Neck 24 extends upwardly from shoulder 38 to define opening 26 opposite shoulder 38 at a topmost edge of neck 24. Opening 26 provides access to storage chamber 22 through neck 24. Neck 24 additionally defines an interior neck surface 82, which is substantially smooth, in one embodiment. Where neck 24 is threaded to receive a closure, such as closure 126, threads 84 extend circumferentially around exterior neck surface 80. In one embodiment, two sets of opposing threads 84 are used to allow closure 126 to be tightly held over neck 24 without requiring excessive rotation of closure 126.

Interior surface 82 of neck 24 defines an inner shelf or inner ledge 86 near opening 18, according to one embodiment. Inner ledge 86 is formed by a thinning of the overall material thickness of neck 24 at inner ledge 86 and above (i.e., toward an opening 26 of bottle 12). As such, inner ledge 86 is annular and defines a topmost surface 88. Inner ledge 86 is configured to interface with dispensing insert 14 to provide for secure and accurate placement of dispensing insert 14 within neck 24 as will be further described below. Inner ledge 86 is one example of means for recessing dispensing insert 14 in neck 24.

In one embodiment, ledges or wings 90 extend radially outwardly from exterior neck surface 80 from positions vertically closer to shoulder 38 than opening 26. For example, each of two wings 90 extend from exterior neck surface 80 radially outwardly in a different direction toward a different one of side panels 34. Each wing 90 is fairly broad and flat in nature. In one embodiment, each wing 90 has a width measured from exterior neck surface 80 to an free end of each wing 90 of at least about 30% of, more preferably, at least about 40%, a outside diameter of neck 24. In one example, a width measured from an outermost edge of one of wings 90 to an outermost edge of the other of one of wings 90 is equal to at least about 75%, more preferably, at least about 85%, a width of the shoulder 38 or overall width of body 20 as a whole and/or at least about 130%, more preferably, at least about 140%, a width or outer diameter of neck 24.

In one example, each wing 90 includes a ramped protrusion 92 extending upwardly from a top surface of each wing 90. For instance, referring to FIG. 1, each ramped protrusion 92 is formed on a leading half of the corresponding wing 90, wherein the leading half is considered the first half of the corresponding wing 90 encountered when an item or portion of closure 126 is turned clockwise to tighten closure 126 around neck 24. In one embodiment, ramped protrusions 92 facilitate proper coupling of closure 126 to body 20, for example, in a similar manner as described in U.S. patent application Ser. No. 13/281,338, filed Oct. 25, 2011, which is incorporated herein by reference in its entirety.

FIGS. 4-9 illustrate dispensing insert 14, according to one embodiment, adapted to fit within neck 24 to convert bottle 12 to more easily allow for dispensing of liquid medicine 28 using oral or other needleless syringe 180 (FIG. 14) as will be more fully described below. In one embodiment, dispensing insert 14 includes a hollow cylindrical body 100, which defines an outer surface 110, and a plurality of annular fins or annular rims 102 extending radially outwardly from outer surface 110 to snugly interface with interior surface 82 of neck 24. More specifically, each one of the plurality of annular rims 102 is axially spaced from one another along cylindrical body 100. In one example, annular rims 102 include at least two, and in one embodiment, three or more annular rims 102, each providing a barrier configured to substantially prevent the passage of liquid medicine 28 or air between dispensing insert 14 and interior surface 82 of neck 24. In one embodiment, each annular rim 102 is substantially planar. Each of annular rims 102 flex slightly when slid into neck 24 to tightly and frictionally interface with interior surface 82 of neck 24. The flexure of annular rims 102 allows dispensing insert 14 to be used with various bottles having similar but not truly identical internal neck diameters. In one embodiment, dispensing insert 14 does not include any annular rims 102. In one embodiment, instead or in addition to annular rims 102, cylindrical body 100 bows radially outwardly near a vertically centered portion thereof to provide additional friction to the friction fitting of dispensing insert 14 within neck 24.

In one embodiment, dispensing insert 14 additionally includes a top panel or top plate 104, a raised deck 106, and a sidewall 108 such as an annular and tapered protrusion from top plate 104 to raised deck 106. Top plate 104 is substantially planar and positioned above and parallel to annular rims 102. However, top plate 104 is formed thicker or otherwise formed to be substantially more rigid than annular rims 102 such that top plate 104 generally does not readily bend due to interaction with interior surface 82 of neck 24. In one embodiment, an outer diameter of top plate 104 is sized substantially identically (in one example, slightly smaller than) a diameter of interior surface 82 of neck 24 just above inner ledge 86 and larger than a diameter of interior surface 82 of neck 24 below inner ledge 86.

In one embodiment, raised deck 106, which is substantially planar, is spaced above, extends substantially parallel to, and is coaxially positioned relative to top plate 104. In one example, raised deck 106 extends above top plate 104 a distance more than about twice, in one embodiment, a distance more than three times, a thickness of top plate 104. Raised deck 106 is shaped similarly to (e.g., circular), but has an outer diameter sized smaller than (e.g., less than about 60% of the diameter of, and in one embodiment, less than about 50% the diameter of) top plate 104. Sidewall 108 extends from an internal position of top plate 104 (i.e., a position spaced radially inwardly from an outer or peripheral edge of top plate 104) to an outer periphery of raised deck 106, for example, in a manner tapering inwardly to raised deck 106. In one example, top plate 104 is open inside sidewall 108. Sidewall 108 extends upwardly beyond raised deck 106, to define a rim 112 around raised deck 106 according to one embodiment, thereby defining a depressed top area 114 above raised deck 106 and inside and below a top edge of rim 112.

An aperture or opening 116 is defined through raised deck 106 to provide access to storage chamber 22 of bottle 12 through dispensing insert 14. In one example, a skirt 118 extends from opening 116 downwardly at least partially through a center of dispensing insert 14 (see, e.g., the cross section of FIG. 13). Skirt 118 is configured to interface with syringe 180 to provide an extended interference fit that substantially blocks the flow of any liquid medicine 28 around syringe 180. In one embodiment, dispensing insert 14 is injection molded or otherwise formed as single piece of material. In one example, dispensing insert 14 is formed of plastic such as low-density polyethylene (LDPE).

Figure 13:
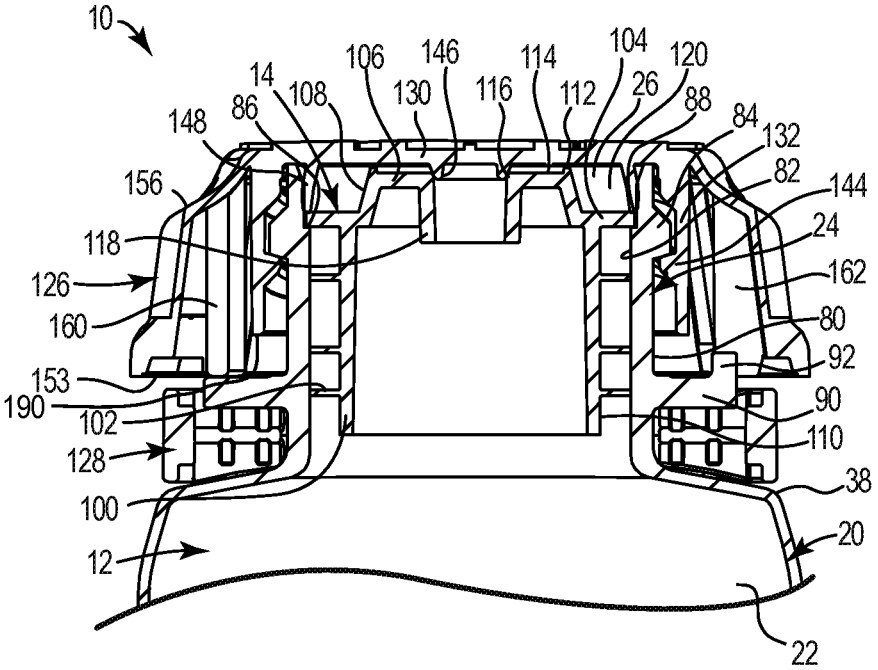
FIG. 13 is a cross-sectional view illustration taken along the line 13-13 in FIG. 12, according to one embodiment of the invention.

When a pharmacist or other suitable individual is filling a prescription for liquid medicine 28 that will utilize needleless syringe 180 (FIG. 14) for dispensing medicine 28 to the patient, dispensing insert 14 is placed in neck 24 of bottle 12. More particularly, dispensing insert 14 is substantially coaxially aligned with opening 26 in neck 24 and is subsequently pushed down into neck 24 until a bottom surface of top plate 104 interfaces with top surface 88 of inner ledge 86 of neck 24 as shown in FIG. 13. In one embodiment, interior surface 82 of neck 24 tapers slightly outwardly and upwardly as it nears opening 26 to allow dispensing insert 14 to more easily slide into neck 24.

In pushing dispensing insert 14 into neck 24, annular rims 102 bend slightly upwardly as they tightly interface with and slide along interior surface 82 of neck 24. In this manner, each annular rim 102 tightly presses against interior surface 82 of neck 24 forming a seal to substantially prevent any flow of liquid medicine along interior surface 82 of neck 24 toward opening 26. As such, the plurality of annular rims 102 provides multiple seals or barriers substantially stopping medicine 28 from inadvertently leaking out of bottle 12 around dispensing insert 14 and substantially decreasing air entering bottle 12 around dispensing insert 14 during dispensing of medicine 28 from bottle 12. In one embodiment, where annular rims 102 are not included, cylindrical body 100 bows outwardly to tightly interface with interior surface 82 of neck to provide at least one barrier for medicine 28 to escape through neck 24 around edges of dispensing insert 14, as will be apparent to one of skill in the art upon reading this application.

Once bottle 12 and dispensing insert 14 are coupled to one another, rim 112 is positioned to be substantially at the same level or on the same plane as or lower than a topmost edge of neck 24. In this manner, voids 120 are defined between interior surface 82 of neck 24 and sidewall 108 as best shown in FIG. 13.

In one embodiment, in preparing an associated prescription, the pharmacist or other suitable individual also places a ring 128 around neck 24. In one embodiment, a plurality of rings 128 each having substantially identical structure, but a different coloring, external surface ornamentation, or other external visual differentiator are available to the pharmacist or other suitable individual preparing a prescription. During prescription preparation, one of the rings 128 is chosen having an external visual differentiator that is assigned to the patient receiving the prescription (either at the time the prescription is filled or prior). In one embodiment, the different ones of rings 128, for example, rings 128 that are each substantially identical other than coloring, surface ornamentation, etc. are configured to visually associate each corresponding bottle assembly with a family or household member. More particularly, in one example, each family member or household member is assigned a color or surface ornamentation associated with one of rings 128. Each time the respective family or household member has a prescription filled, one of rings 128 with the same colored or surface ornamentation is used on a corresponding one of bottles 12 readily visually associating each of the bottles 12 with the appropriate family or household member. In view of the above, any of rings 128 with associated color and/or surface ornamentation are means for visually associating the bottle with a patient who was prescribed a corresponding medication in comparison to other members of the family or household of the patient.

In one embodiment, each ring 128 is formed of substantially rigid, yet slightly flexible material, such as a non-elastomeric plastic or similar material, and is configured to fit around neck 24 of container 20, more specifically, to rest above shoulder 38 and sit just below wings 90 (see FIG. 13). While substantially rigid, ring 128 is configured to slightly flex to fit over neck 24 and wings 90 of bottle. More particularly, by applying force to opposite ends of ring 128, ring 128 flexes and ring 128 is able to slide down around neck 24, over wings 128, and onto bottle 12 just above shoulder 38. When unflexed, ring 128 is not readily moved back over wings 128 and off of bottle 12, such that ring 128 is thereby secured to bottle 12.

FIGS. 10-13 illustrate one closure 126 for bottle 12, according to one embodiment of the present invention. As illustrated, closure 126 is child resistant, although non-child-resistant closures are also contemplated for use with the invention described herein. Closure 126 includes a top panel 130, an inner sidewall or inner skirt 132, and an outer sidewall or outer skirt 134. Top panel 130 is ovular, although other suitable shapes are also contemplated, and defines an exterior surface 136 and an interior surface 138 opposite exterior surface 136. Inner skirt 132 is circular, configured to interface with neck 24 of bottle 12, and extends downwardly from and is centered on interior surface 138 of top panel 130. Inner skirt 132, more particularly, defines an outer surface 140 and an inner surface 142 opposite outer surface 140. Inner skirt 132 is threaded, for example, double threaded with threads 144, to interface with threads 84 around neck 24 to securely hold closure 126 on neck 24 and over opening 26 of bottle 12.

In one example, closure 126 additionally includes an inner protruding ring 146 and an outer protruding ring 148 both protruding downwardly from interior surface 138 of top panel 130 inside inner skirt 132. Inner protruding ring 146 and outer protruding ring 148 are configured to interface with dispensing insert 14 to assist in housing and dispensing liquid medications 28 in a liquid-tight manner as further described below.

Figure 11:
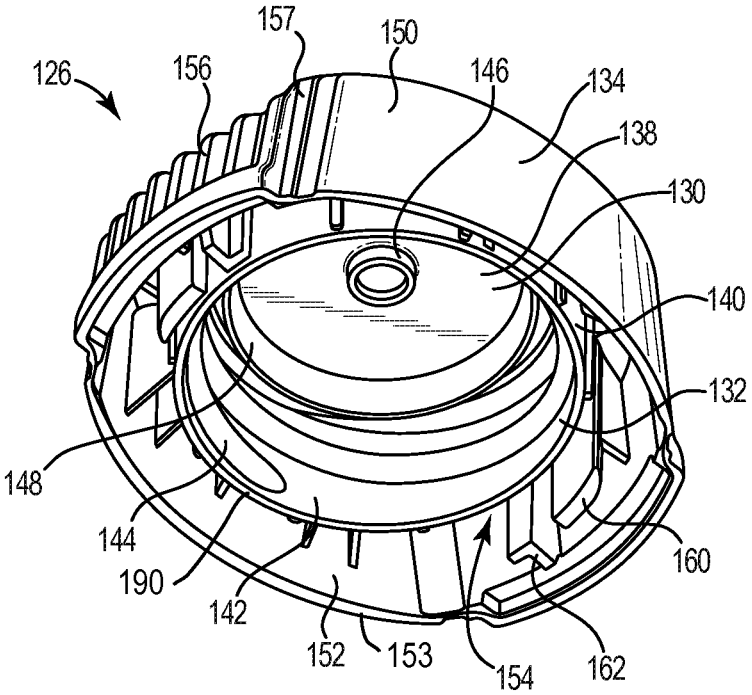
FIG. 11 is a rear, bottom perspective view illustration of the closure of FIG. 10, according to one embodiment of the invention.
Figure 12:
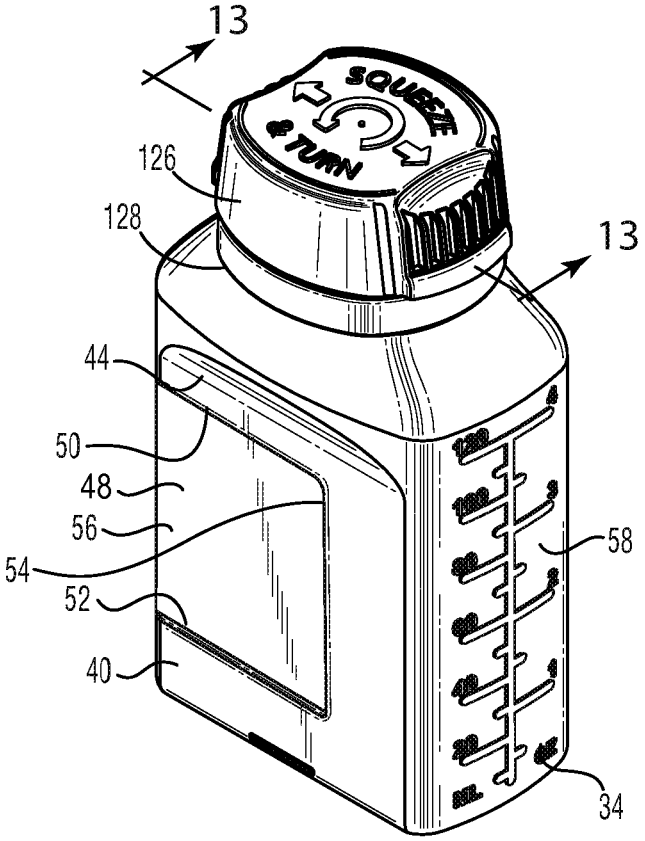
FIG. 12 is a front, top perspective view illustration of a medicine containment and dispensing system including the bottle and liquid dispensing insert of FIG. 1 and the closure of FIG. 10, according to one embodiment of the invention.

Outer skirt 134 extends downwardly from the outermost perimeter of top panel 130, in one example, with a slight outward flare. A bottom-most edge of outer skirt 134 has an outer perimeter, at least along front and back portions, which is configured to extend substantially coterminous with an outer perimeter of ring 128, according to one embodiment. Outer skirt 134 includes an outer surface 150, an inner surface 152 opposite outer surface 150, and a bottom edge 153 (FIGS. 11 and 13). As illustrated, a void 154 is defined between outer surface 140 of inner skirt 132 and inner surface 152 of outer skirt 134. Void 154 allows outer skirt 134 to deform under outside forces even while inner skirt 132 is secured around neck 24 of bottle 12. In one embodiment, outer skirt 134 extends further away from top panel 130 than inner skirt 132 such that a bottom edge 190 of inner skirt 132 is positioned nearer top panel 130 than the bottom edge 153 of outer skirt 134.

Outer skirt 134, in one embodiment, includes opposing grip sections 156 on opposite sides of outer skirt 134 coupled to a remainder of outer skirt 134 on each side by a transitional section 157, which is substantially thinner than a remainder of outer skirt 134. The thin transitional section 157 permits deflection of opposing grip sections 156 relative to the rest of outer skirt 134 when external force (i.e., pinching by a user) squeezes the opposing grip sections 156 toward one another. In one embodiment, grip sections 156 are configured with various features facilitating a user in gripping and squeezing the appropriate portions of closure 126. In one example, closure 126 additionally includes raised indicia 158 protruding slightly upwardly from exterior surface 136 of top panel 130 and providing instructions to a user for interacting with closure 126. For example, raised indicia 158 may include text and graphic indications instructing a user to squeeze grip sections 156 and turn closure 126 to remove closure 126 from the respective bottle 12 to open bottle 12 and access its contents.

In one example, closure 126 includes additional features positioned between inner skirt 132 and outer skirt 134 to establish closure 126 as being child-resistant. In one embodiment, the additional features of closure 126 include ramp protrusion 160 and stops 162. One of ramp protrusions 160 is positioned to extend into void 154 from inner surface 152 of outer skirt 134 and extends downwardly below bottom edge 190 of inner surface 152. Ramped protrusions 160 are angled and configured to interface with ramped protrusion 92 of bottle such that each ramped protrusion 160 easily slides over and past a corresponding ramped protrusion 92 of bottle 12 when closure 126 is turned clockwise due to the angles of ramped protrusions 92 and 160. The same angles of ramped protrusions 92 and 160 make it substantially difficult, i.e., near impossible for a child, to turn closure 126 counterclockwise to move ramped protrusions 160 back over and past ramped protrusion 92 to remove closure 126 from bottle 12.

One of stops 162 is positioned to extend inwardly from inner surface 152 of outer skirt 134, more specifically, grip sections 156 of outer skirt 134, spaced just slightly from trailing end of each ramped protrusion 160. Each stop 162 is configured to interface with one of ramped protrusions 92 of bottle 12 to prevent over-rotation or tightening of closure 26 relative to neck 24 of bottle 12 and extends below a bottom edge of inner skirt 132.

When properly fitted on bottle 12, as described above, closure 126 also interfaces with interior surface 82 of neck 24 and dispensing insert 14 to seal off opening 26 during storage or non-use. More specifically, referring to FIG. 13, inner protruding ring 146 is sized and positioned to fit just within and tightly interface with opening 26 and/or skirt 118. This seal substantially prevents escape of liquid medicine 28 out of opening 26 when closure 126 is secured to bottle 12. In addition, when closure 126 is secured, interior surface 138 of top panel 130 fits tightly against top of rim 112 and outer protruding ring 148 fits just inside interior surface 82 of neck 24 within void 120. Both of the above-described interactions further prevent liquid medicine 28 from escaping from bottle 12 when closure 26 is secured thereto in addition to preventing air or other contaminates from reaching liquid medicine 28, thereby, increasing the viable lifespan of liquid medicine 28. In one embodiment, outer protruding ring 148 also interfaces with a top surface of top plate 104 of dispensing insert 14.

Figure 15:
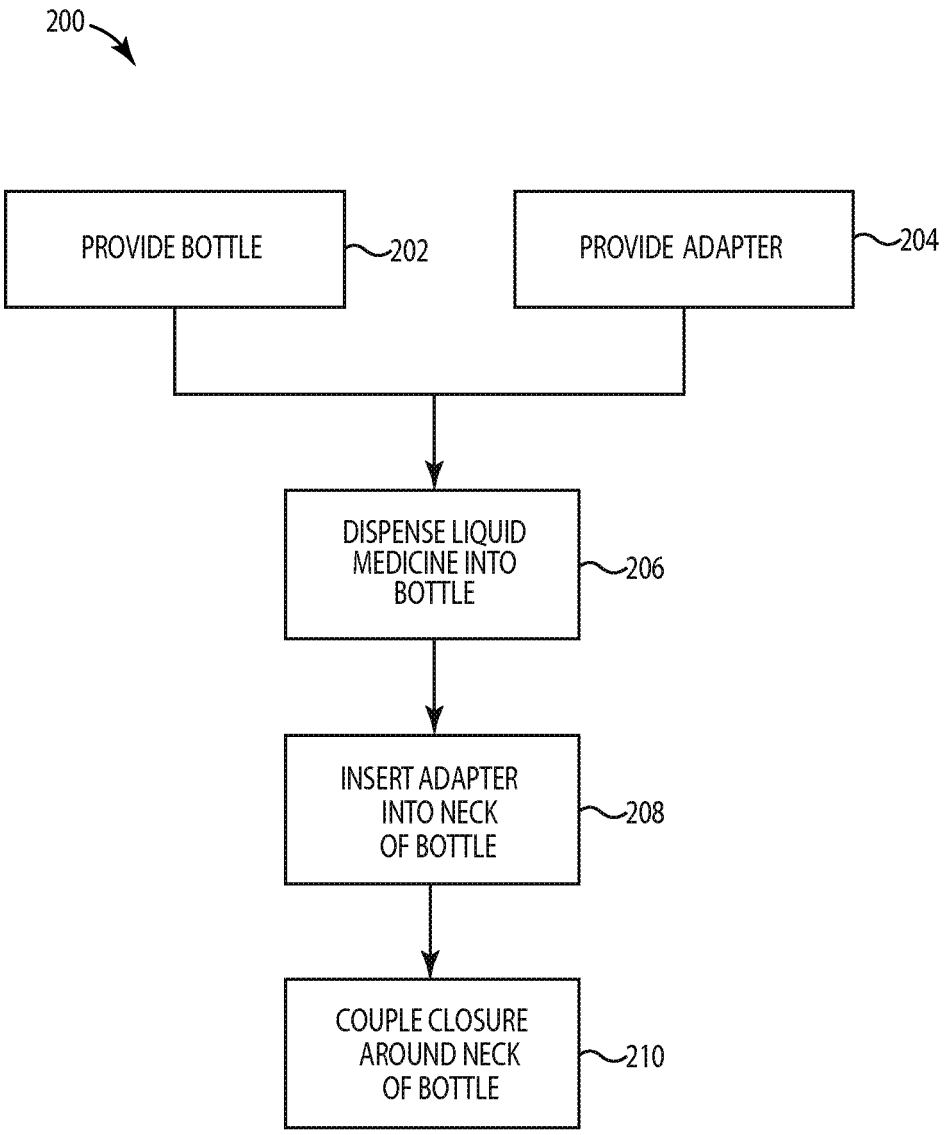
FIG. 15 is a flow chart illustrating of a method of assembling medicine containment and dispensing system, according to one embodiment of the invention.

FIG. 15 illustrates one example of a method 200 of assembling medicine containment and dispensing system 10 described with additional reference to FIGS. 1-13. At 202, bottle 12 is provided including a neck 24 with an opening 26 and an inner ledge 86. In one example, a variety of sizes of bottles 12 are available all having a similarly sized and configured neck 24 such that any of the variety of sizes of bottles 12 can similarly receive dispensing insert 14. At 204, dispensing insert 14 (otherwise known as an adapter) is provided as illustrated in FIGS. 4-9 and described in detail above.

At 206, liquid medicine 28 is poured or otherwise dispensed into bottle 12. Subsequently, at 208, dispensing insert 14 is substantially coaxially aligned with opening 26 in neck 24 and is inserted and pushed down into neck 24 until a bottom surface of top plate 104 of dispensing insert 14 interfaces with top surface 88 of inner ledge 86 of neck 24 as shown in FIG. 13. In pushing dispensing insert 14 into neck 24, in one embodiment, annular rims 102, or other suitable portion of dispensing insert 14 form at least one seal against interior surface 82 of neck 24 to substantially prevent any flow of liquid medicine 28 along interior surface 82 of neck 24 toward opening 26. Once bottle 12 and dispensing insert 14 are coupled to one another, rim 112 is positioned to be substantially at the same level or on the same plane as or below a topmost edge of neck 24 such that dispensing insert 14 is entirely maintained within neck 24, according to one embodiment.

At 210, closure 126 is secured to bottle 12 in a manner interacting with both bottle 12 and dispensing insert 14 to effectively seal opening 26. In one example threads 144 of closure 126 are spun around threads 84 of neck 24 to secure closure 126 to neck 124. When fully closed and properly positioned, inner protruding ring 146 of closure 126 directly interfaces with opening 26 and/or skirt 118 to provide a first barrier to inadvertent escape of liquid medicine 28 from bottle 12, rim 112 around raised deck 106 of dispensing insert 14 interfaces with top panel 130 of closure 126 to form a second barrier to inadvertent escape of liquid medicine 28 from bottle 12, and outer protruding ring 148 interfaces with both interior surface 82 of neck 24 and top surface of top plate 104 of dispensing insert 14 to form a third barrier to inadvertent escape of liquid medicine 28. The above-described barriers also decrease the amount of air or other contaminants entering bottle 12 from the environment, thereby increasing the viable lifespan of liquid medicine 28 contained therein. Once closure 126 is secured at 210, bottle 12 with liquid medicine 28 is presented or delivered to the patient for use.

Figure 16:
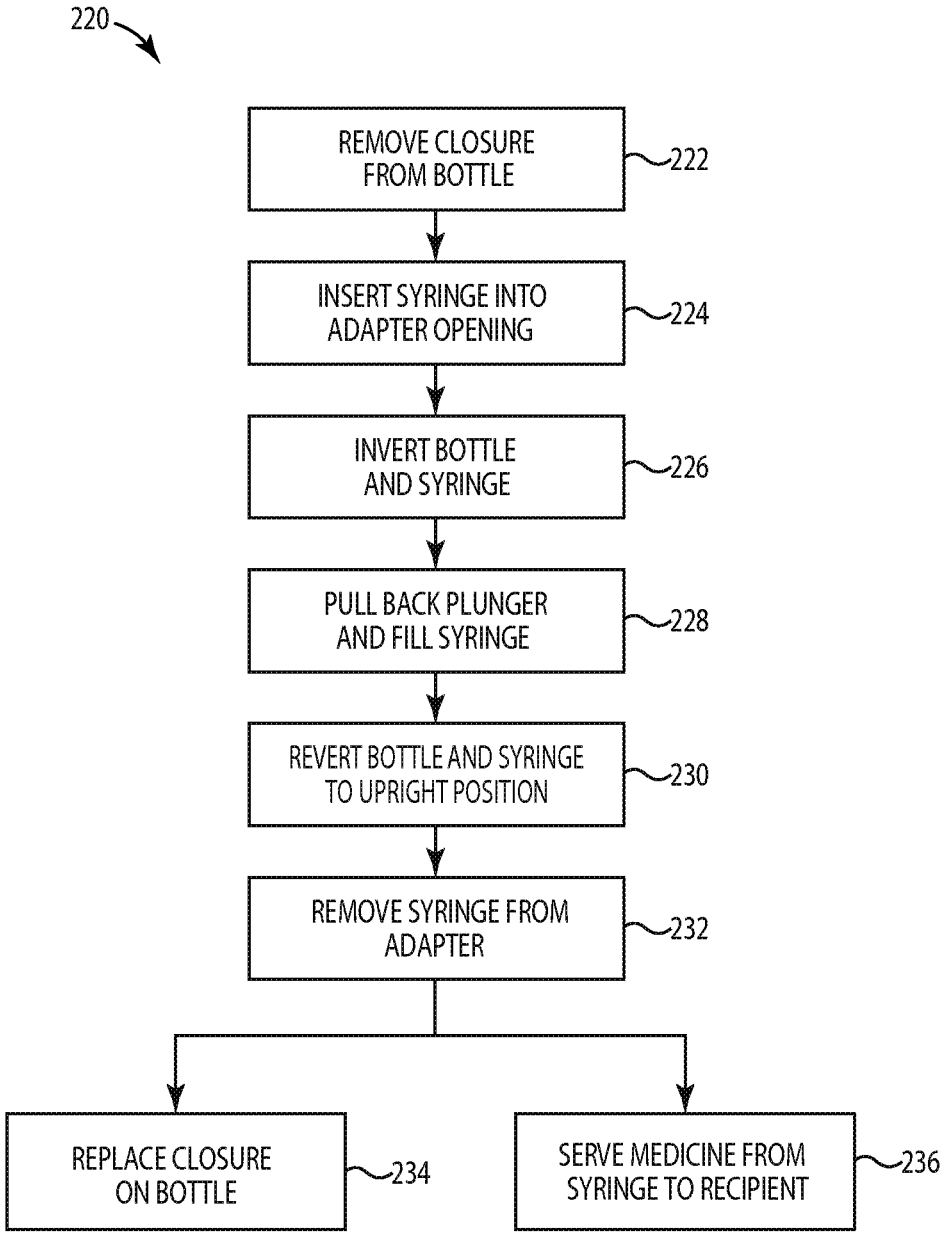
FIG. 16 is a flow chart illustrating of a method of using medicine containment and dispensing system, according to one embodiment of the invention.

FIG. 16 illustrates a method 220 of using medicine and containment system 10, according to one embodiment, performed, for example, by a patient or caregiver. At 222, closure 126 is removed from bottle 12, for example, by rotating closure 126 in a counterclockwise manner to un-mate threads 144 of closure 126 and threads 84 of neck 24. At 224, needleless syringe 180 is inserted into opening 116 in dispensing insert 14. In one embodiment, oral syringe 180 includes an elongated tapered tip 182 with an opening 184 at an outer end thereof providing access through elongated tapered tip 182 to chamber 186 in an opposing back end of oral syringe 180. Oral syringe 180 additionally includes plunger 188 configured to move out of and into chamber 186 to selectively draw up liquid into and push liquid out of chamber 186 as will be apparent to those of skill in the art upon reading this application. Inserting oral syringe 180 into opening 184, more specifically, includes inserting elongated tapered tip 182 into opening 26 and through skirt 118 to access or at least be placed in communication with storage chamber 22 of bottle 12. In one embodiment, when so positioned, elongated tapered tip 182 is pressed tightly against skirt 118 at more than just a thin interface line immediately adjacent opening 116. The length of skirt 118 serves to maintain oral syringe in a desired angle (e.g., substantially 90 degrees) relative to raised deck 106 an angle orientation.

At 226, bottle 12 and needleless syringe 180 are collectively inverted as illustrated in FIG. 14. Due to the tapered nature of sidewall 108, when bottle 12 is inverted, liquid medicine 28 is funneled toward opening 116 (rather than settling into edges adjacent interior surface 82 of neck 26) and, therefore, toward needleless syringe 180. In this manner, more of medicine 28 is able to be drawn out of bottle 12, for example, when only a small amount of medicine 28 remains in bottle 12, resulting in less wasted medicine 28. After inversion of bottle 12 and needleless syringe 180, at 228, plunger 188 is pulled back (or down in the orientation of FIG. 14) drawing liquid medicine 28 into chamber 186 via opening 184. Once a desired amount of medicine 28 has been drawn into chamber 186 of needleless syringe 180, determined, for example, by references to measurement demarcations on a side of needleless syringe 180, bottle 12 and needleless syringe 180 are returned to their upright or nearly to their upright position at 230, and at 232 needless syringe 180, more particularly, elongated tapered tip 182 of needleless syringe 180, is removed from dispensing insert 14 and bottle 12. The dosage of medicine 128 drawn into needleless syringe 180 is administered to the patient at 236 by pushing plunger 188 of needleless syringe 180 into chamber 186 forcing medicine 128 out of chamber 186 out of opening 184 of needleless syringe 180.

Although specific embodiments have been illustrated and described herein, it will be appreciated by those of ordinary skill in the art that a variety of alternate and/or equivalent implementations may be substituted for the specific embodiments shown and described without departing from the scope of the present invention. This application is intended to cover any adaptations or variations of the specific embodiments discussed herein. Therefore, it is intended that this invention be limited only by the claims and the equivalents thereof.

What is claimed is:

1. A bottle system comprising:

a dispensing insert configured to friction fit within a neck of a pharmacy bottle and to selectively receive an oral syringe, the dispensing insert defining: a hollow cylinder;

a top plate capping one end of the hollow cylinder;

a raised deck extending substantially parallel to and spaced from the top plate, the raised deck having a smaller outer diameter than the top plate and defining an opening therethrough configured to provide access to contents of the pharmacy bottle through the dispensing insert; and an annular sidewall extending from the top plate upwardly toward the raised deck, wherein the annular sidewall substantially encompasses an outer perimeter of the raised deck; and a closure for the bottle, wherein:

the closure is configured to fit around the neck of the bottle, the closure includes a top panel, which defines an interior surface, and a protruding ring, and the protruding ring extends downwardly from the interior surface of the top panel to fit directly adjacent an internal surface of the neck and to abut the top plate of the dispensing insert.

2. The bottle system of claim 1, wherein the raised deck is coaxially positioned relative to the top plate.

3. The bottle system of claim 1, wherein the raised deck and the top plate are each circular in shape.

4. The bottle system of claim 1, wherein the annular sidewall extends beyond a top surface of the raised deck to define a rim extending above the raised deck, the rim circumferentially extending around the outer perimeter of the raised deck.

5. The bottle system of claim 1, wherein the raised deck is spaced from the top plate a distance equal to or greater than about three times a thickness of the top plate.

6. The bottle system of claim 1, wherein the annular sidewall tapers radially inwardly from the top plate to the outer perimeter of the raised deck.

7. The bottle system of claim 1, further comprising a skirt extending downwardly from the opening into the hollow cylinder.

8. The bottle system of claim 1, further comprising a plurality of annular fins each extending around the hollow cylinder and being spaced from other ones of the plurality of annular fins, wherein each of the plurality of annular fins is substantially planar and extends substantially parallel to the top plate.

9. The bottle system of claim 1, wherein:

the top plate extends substantially continuously from an outer periphery thereof to the annular sidewall, the raised deck is coaxially positioned relative to the top plate, the raised deck and the top plate are each circular in shape, the annular sidewall extends beyond a top surface of the raised deck to define a rim continuously extending above the raised deck and entirely around the opening, the raised deck is spaced from the top plate a distance equal to or greater than about three times a thickness of the top plate, the side wall tapers radially inwardly from the top plate to the outer perimeter of the raised deck, and the dispensing insert further comprises a skirt extending downwardly from the opening into the hollow cylinder.

10. The bottle system of claim 1, further comprising the bottle, wherein the neck of the bottle defines an inner ledge spaced downwardly from a topmost edge of the neck, the dispensing insert fits within the neck such that outer edges of the top plate sit adjacent the inner ledge and the dispensing insert entirely sits at or below the topmost edge of the neck.

11. The bottle system of claim 10, wherein the top plate is offset from the topmost edge of the neck.

12. The bottle system of claim 10, further comprising liquid medicine contained within the bottle.

13. The bottle system of claim 1, wherein the annular sidewall of the dispensing insert extends beyond a top surface of the raised deck to define a rim circumferentially extending above the raised deck.

14. The bottle system of claim 13, wherein the closure includes a further inner protruding ring extending downwardly from the interior surface which fits snugly within the opening through the raised deck when the closure is secured around the neck of the bottle, and the interior surface of the top panel abuts the rim of the dispensing insert forming a seal between the top panel and the rim of the dispensing insert when the closure is secured around the neck of the bottle.

15. The bottle system of claim 1, wherein the dispensing insert is formed as a single piece.

16. A medication containment and dispensing system comprising:

a bottle including a body and a neck extending away from the body to a top edge of the bottle, the bottle defining an inner ledge along an interior surface of the neck;

an adapter including a hollow cylinder fit within the neck of the bottle, a first circular panel extending across a top of the hollow cylinder, a raised deck extending parallel to and spaced from the first circular panel, and an annular sidewall extending upwardly and radially inwardly from the first circular panel toward the raised deck, wherein the annular sidewall substantially encompasses an outer perimeter of the raised deck, the raised deck has a smaller outer diameter than the first circular panel, the raised deck defines an opening therethrough to provide access to any contents of the bottle through the adapter, and the adapter is formed as a single piece; and a closure including a top substantially planar section and an annular protrusion extending downwardly from the top substantially planar section to interface with the interior surface of the neck and a top surface of the first circular panel.

17. The medication and containment system of claim 16, wherein the annular sidewall interfaces with the top substantially planar section.

18. The medication and containment system of claim 16, wherein the raised deck is spaced above the first circular panel a distance at least equal to about three times a thickness of the first circular panel and surrounded by the annular sidewall.

19. The medication and containment system of claim 18, wherein the adapter includes a cylindrical skirt extending downwardly from the first circular panel into an interior of the hollow cylinder.

20. A bottle system for dispensing a liquid medicine, the bottle system comprising:

means for containing the liquid medicine;

means for defining a narrow passageway to the means for containing, the means for defining the narrow passageway defining an opening at a topmost portion thereof;

an adapter defining a primary panel, a secondary panel longitudinally offset from the primary panel a distance equal to at least twice a thickness of the primary panel, and a sidewall angled inwardly from an internal portion of the primary panel to an outer periphery of the secondary panel, wherein the secondary panel is smaller than the primary panel and defines means for receiving a needle less syringe therethrough, and the adapter is formed as a single piece of a material;

means for recessing the adapter within the narrow passageway such that the primary panel and the secondary panel are substantially spaced downwardly from the opening of the means for defining the narrow passageway; and a closure for the bottle, wherein:

the closure is configured to fit around the narrow passageway, the closure includes a top panel, which defines an interior surface, and a protruding ring, and the protruding ring extends downwardly from an interior surface of the top panel to fit directly adjacent an internal surface of the narrow passageway and to abut the secondary panel of the adapter.

21. The bottle system of claim 20, wherein the sidewall includes means for interfacing with a top panel of a closure spaced above the secondary panel.

* * * * *